US009081337B2

(12) United States Patent
Nakano et al.

(10) Patent No.: US 9,081,337 B2
(45) Date of Patent: Jul. 14, 2015

(54) FIXING DEVICE ENSURING SMOOTH DELIVERY OF SHEET

(71) Applicant: Kyocera Document Solutions Inc., Osaka (JP)

(72) Inventors: Kuniaki Nakano, Osaka (JP); Yuuya Shimohora, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/470,966

(22) Filed: Aug. 28, 2014

(65) Prior Publication Data

US 2015/0063881 A1 Mar. 5, 2015

(30) Foreign Application Priority Data

Aug. 28, 2013 (JP) ..... 2013-176513

(51) Int. Cl.
*G03G 15/20* (2006.01)

(52) U.S. Cl.
CPC ..... *G03G 15/2028* (2013.01)

(58) Field of Classification Search
USPC ..... 399/122, 320–323, 397–400
See application file for complete search history.

(56) References Cited

U.S. PATENT DOCUMENTS 5,289,244 A * 2/1994 Takano ..... 399/322
2012/0057887 A1* 3/2012 Kameda et al. ..... 399/44
2012/0207523 A1* 8/2012 Ueno et al. ..... 399/322

FOREIGN PATENT DOCUMENTS

JP 2010-039318 2/2010

* cited by examiner

*Primary Examiner* — Hoan Tran
(74) *Attorney, Agent, or Firm* — James W. Judge

(57) ABSTRACT

A fixing device includes a fixing member, a pressure member, and a guiding member. The guiding member includes a first guide surface, a second guide surface, and a pair of third guide surfaces consecutively installing both end portions in the axial direction of the first guide surface and both end portions in the axial direction of the second guide surface. The first end edge of the first guide surface has a first circular arc shape arranged such that a center portion in the axial direction projects toward the downstream side in the rotation direction with respect to both end portions in the axial direction. The second guide surface is one of a curved surface in a second circular arc shape arranged such that a center portion in the axial direction is close to the first circumference surface with respect to both end portions in the axial direction.

6 Claims, 9 Drawing Sheets

FIXING DEVICE ENSURING SMOOTH DELIVERY OF SHEET

CROSS-REFERENCE TO RELATED APPLICATION

This application is based upon, and claims the benefit of priority from, corresponding Japanese Patent Application No. 2013-176513 filed in the Japan Patent Office on Aug. 28, 2013, the entire contents of which are incorporated herein by reference.

BACKGROUND

Unless otherwise indicated herein, the description in this section is not prior art to the claims in this application and is not admitted to be prior art by inclusion in this section.

A typical image forming apparatus includes an image forming unit and a fixing device. On an image carrier of the image forming unit, a toner image is formed. The toner image is transferred onto a sheet. The fixing device performs a fixing process on the sheet. As a result, the toner image is fixed to the sheet.

There is provided a fixing device that includes a fixing roller and a pressure roller, which rotates in abutting contact with each other. Between the fixing roller and the pressure roller, a fixing nip portion is formed. When a sheet passes through the fixing nip portion, a toner image is fixed to the sheet. Additionally, the fixing device includes a guiding member. The guiding member guides the sheet toward the fixing nip portion. On the fixing nip portion side of the guiding member, an inclined surface is arranged. The inclined surface is arranged across a tangent line drawn at the entrance of the fixing nip portion.

SUMMARY

A fixing device according to a one aspect of the disclosure is a fixing device for performing a fixing process on a sheet including a first sheet surface on which a toner image is formed. The fixing device includes a fixing member, a pressure member, and a guiding member. The fixing member includes a first circumference surface. The fixing device is configured to rotate the fixing member in a predetermined rotation direction. The fixing device is configured to bring the first circumference surface into contact with the first sheet surface. The pressure member includes a second circumference surface. The fixing device is configured to press the pressure member against the first circumference surface of the fixing member so as to form a fixing nip portion through which the sheet passes between the pressure member and the fixing member. The fixing device is configured to bring the second circumference surface into contact with a second sheet surface on an opposite side of the first sheet surface. The guiding member is arranged at a predetermined distance from the first circumference surface. The guiding member is configured to bring the sheet into abutting contact with the first circumference surface of the fixing member and then guide the sheet to the fixing nip portion. The first circumference surface of the fixing member is constituted to have a smaller outer diameter of the center portion in an axial direction during the rotation than outer diameters of both end portions in the axial direction. The guiding member includes a first guide surface, a second guide surface, and a pair of third guide surfaces. The first guide surface includes a first end edge arranged to face the first circumference surface. The first guide surface is located to extend toward the first circumference surface at an upstream side of the fixing nip portion in the rotation direction. The first guide surface is configured to guide the sheet to the first circumference surface. The second guide surface is at a downstream side of the first guide surface in the rotation direction. The second guide surface is consecutively installed on the first guide surface to intersect with the first guide surface in a center in the axial direction of the first end edge. The second guide surface is arranged along the first circumference surface. The pair of third guide surfaces consecutively install both end portions in the axial direction of the first guide surface and both end portions in the axial direction of the second guide surface. In a view from a direction perpendicular to the first guide surface, the first end edge of the first guide surface has a first circular arc shape arranged such that a center portion in the axial direction projects toward the downstream side in the rotation direction with respect to both end portions in the axial direction. When the second guide surface is viewed from a direction along the second guide surface from the upstream side in the rotation direction, the second guide surface is one of a curved surface in a second circular arc shape and a planar surface, the second circular arc shape is arranged such that a center portion in the axial direction is close to the first circumference surface with respect to both end portions in the axial direction.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
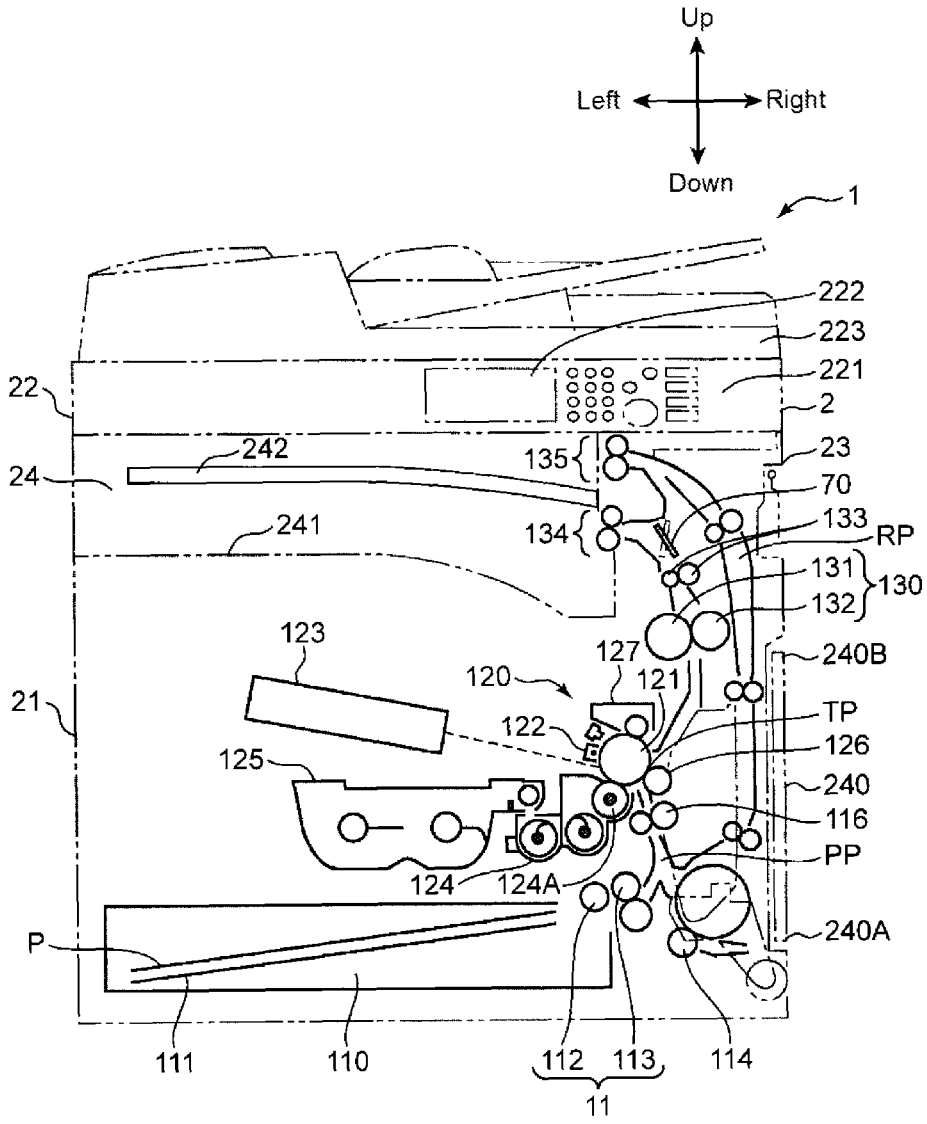
FIG. 1 cross-sectionally illustrates an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes one embodiment of the disclosure with reference to the accompanying drawings. FIG. 1 cross-sectionally illustrates the inside of an image forming apparatus 1 according to one embodiment of the disclosure. The image forming apparatus 1 illustrated in FIG. 1 is what is called a black-and-white printer. However, in another embodiment, an image forming apparatus may be a color printer, a facsimile device, a multi-functional peripheral that has these functions, or another apparatus for forming a toner image on a sheet. In the following description, "Up", "Down", "Front", "Rear", "Left", and "Right" are used as terms expressing directions for simply clarifying the description, and do not limit the principle of an image forming apparatus. In the following description, the term of "sheet" means a copy paper, a coated paper, an OHP sheet, a cardboard, a postcard, a tracing paper, another sheet material subjected to an image formation process, or a sheet material subjected to any process other than the image formation process.

The image forming apparatus 1 includes a main chassis 2 that has an approximately rectangular parallelepiped shape. The main chassis 2 includes a lower chassis 21 in an approximately rectangular parallelepiped shape, an upper chassis 22 in an approximately rectangular parallelepiped shape, and a connection chassis 23. The upper chassis 22 is arranged on the upper side of the lower chassis 21. The connection chassis 23 connects the lower chassis 21 and the upper chassis 22 together. The connection chassis 23 extends along the right edge and the back-side edge of the main chassis 2. The lower chassis 21, the upper chassis 22, and the connection chassis 23 surround a discharge space 24. To the discharge space 24, a sheet on which a printing process is performed is discharged. In particular, in the embodiment, a discharging unit 241 is arranged in the top surface portion of the lower chassis 21. On the upper side of the discharging unit 241, a sheet discharge tray 242 is arranged. To the discharging unit 241 and the sheet discharge tray 242, sheets are discharged.

In the front direction of the upper chassis 22, an operation unit 221 is arranged. For example, the operation unit 221 includes an LCD touch panel 222. The operation unit 221 is formed to ensure input of information related to the image formation process. For example, a user can input the number of sheets to be printed or input the print density through the LCD touch panel 222. Within the upper chassis 22, mainly, a device for reading the image of an original document and an electronic circuit for controlling the entire image forming apparatus 1 are housed.

On the upper chassis 22, a pressing cover 223 is arranged for pressing the original document. The pressing cover 223 is mounted on the upper chassis 22 to turn up and down. The user turns the pressing cover 223 upward to place an original document on the upper chassis 22. Afterward, the user can operate the operation unit 221 to read the image of the original document by the device arranged within the upper chassis 22. The pressing cover 223 is formed of a part of an automatic document feed for feeding an original document to a document placement table (not illustrated) arranged in the top surface portion of the upper chassis 22.

On the right-side surface of the lower chassis 21, a manual bypass tray 240 is arranged. In the manual bypass tray 240, an upper end 240B side can turn up and down around a lower end 240A as a supporting point. While the manual bypass tray 240 is turned downward and set to a position in which the manual bypass tray 240 projects to the right side of the lower chassis 21, the user can place a sheet on the manual bypass tray 240. The sheet on the manual bypass tray 240 is drawn into the lower chassis 21 based on the instruction input by the user through the operation unit 221, undergoes the image formation process, and then is discharged to the discharge space 24.

The image forming apparatus 1 includes a cassette 110, a paper sheet feeder 11, a second paper feed roller 114, a registration roller pair 116, and an image forming unit 120. The paper sheet feeder 11 includes a pickup roller 112 and a first paper feed roller 113. The paper sheet feeder 11 sends out a sheet P to a sheet conveyance path PP. The sheet conveyance path PP is a conveyance path arranged from the paper sheet feeder 11 via the registration roller pair 116 through a transfer position TP, which is arranged within the image forming unit 120, to the discharge space 24.

The cassette 110 houses the sheet P inside. The cassette 110 can be pulled from the lower chassis 21 in the front direction (the front side direction of the paper in FIG. 1). The sheet P housed within the cassette 110 is sent out upward within the lower chassis 21. Afterward, the sheet P undergoes the image formation process within the lower chassis 21 based on the instruction input by the user through the operation unit 221, and then is discharged to the discharge space 24. The cassette 110 includes a lift plate 111 that supports the sheet P. The lift plate 111 is inclined to push up the leading edge of the sheet P toward the upper side.

The pickup roller 112 is arranged on the leading edge of the sheet P, which is pushed up by the lift plate 111 upward. When the pickup roller 112 rotates, the sheet P is extracted from the cassette 110.

The first paper feed roller 113 is arranged at the downstream side in the sheet conveyance direction of the pickup roller 112. The first paper feed roller 113 sends out the sheet P to the further downstream side in the sheet conveyance direction. The second paper feed roller 114 is arranged on the inner side of the lower end 240A of the manual bypass tray 240. The second paper feed roller 114 feeds the sheet P on the manual bypass tray 240 to the inside of the lower chassis 21. The user can selectively use the sheet P housed in the cassette 110 or the sheet P placed on the manual bypass tray 240.

The registration roller pair 116 specifies the position of the sheet in the direction perpendicular to the sheet conveyance direction. Accordingly, the position of an image to be formed on the sheet P is adjusted. The registration roller pair 116 forms a nip portion between the rollers. The registration roller pair 116 feeds the sheet P to the image forming unit 120 in accordance with the timing when a toner image is transferred to the sheet P in the image forming unit 120. Additionally, the registration roller pair 116 has a function that corrects the skew of the sheet P.

The image forming unit 120 includes a photoreceptor drum 121, a charger 122, an exposure device 123, a developing device 124, a toner container 125, a transfer roller 126, and a cleaning device 127.

The photoreceptor drum 121 has a shape of a cylindrical body. The photoreceptor drum 121 has a circumference surface on which an electrostatic latent image is to be formed, and carries the toner image corresponding to the electrostatic latent image.

The charger 122 receives the application of a predetermined voltage, so as to almost uniformly charge the circumference surface of the photoreceptor drum 121. The exposure device 123 irradiates a laser beam to the circumference surface of the photoreceptor drum 121 charged by the charger 122. The laser beam is irradiated in accordance with image data output from an external device (not illustrated) such as a personal computer. The external device is communicatively connected to the image forming apparatus 1. As a result, the electrostatic latent image corresponding to the image data is formed on the circumference surface of the photoreceptor drum 121.

The developing device 124 supplies toner to the circumference surface of the photoreceptor drum 121 on which the electrostatic latent image is formed. The toner container 125 supplies toner to the developing device 124. The supply of toner to the photoreceptor drum 121 by the developing device 124 causes development (visualization) of the electrostatic latent image formed on the circumference surface of the photoreceptor drum 121. As a result, a toner image is formed on the circumference surface of the photoreceptor drum 121. The developing device 124 includes a developing roller 124A that carries toner on its circumference surface. The developing roller 124A is arranged to face the photoreceptor drum 121 in a developing position. The developing roller 124A is rotatably driven to supply the toner to the photoreceptor drum 121.

The transfer roller 126 is arranged to face the circumference surface of the photoreceptor drum 121 in the transfer position TP. The transfer roller 126 is rotatably driven in the same direction as the photoreceptor drum 121 in the transfer position TP. In the transfer position TP, the toner image formed on the circumference surface of the photoreceptor drum 121 is transferred to the sheet P.

The cleaning device 127 removes the toner remaining on the circumference surface of the photoreceptor drum 121 after the toner image is transferred to the sheet P. The circumference surface of the photoreceptor drum 121 cleaned by the cleaning device 127 passes under the charger 122 again so as to be uniformly charged. Subsequently, the above-described formation of a toner image is additionally performed.

The image forming apparatus 1 further includes a fixing device 130 at the downstream side of the image forming unit 120 in the conveyance direction. The fixing device 130 performs a fixing process on the sheet P on which the toner image is formed. The fixing device 130 includes a fixing roller 131 (fixing member) and a pressure roller 132 (pressure member). The fixing roller 131 melts the toner on the sheet P. The pressure roller 132 brings the sheet P into close contact with the fixing roller 131. When the sheet P passes through between the fixing roller 131 and pressure roller 132, the toner image is fixed to the sheet P.

The image forming apparatus 1 further includes a conveyance roller pair 133, a switching unit 70, a lower discharge roller pair 134, and an upper discharge roller pair 135. The conveyance roller pair 133 is arranged on the downstream of the fixing device 130. The switching unit 70 is arranged on the downstream of the conveyance roller pair 133. The conveyance roller pair 133 conveys the sheet P on which the fixing process is performed by the fixing device 130 to the downstream side in the sheet conveyance direction. The switching unit 70 has a function that switches the conveyance directions of the sheet P at the downstream side in the sheet conveyance direction of the conveyance roller pair 133. The lower discharge roller pair 134 is arranged on the left side of the switching unit 70, and discharges the sheet P conveyed by the conveyance roller pair 133 to the discharging unit 241. The upper discharge roller pair 135 is arranged on the upper side of the lower discharge roller pair 134, and discharges the sheet P, which is conveyed by the conveyance roller pair 133, to the sheet discharge tray 242 mounted on the upper side of the discharging unit 241. The upper discharge roller pair 135 inverts its rotation direction so as to convey the sheet P in an reversing conveyance path RP. The sheet P conveyed in the reversing conveyance path RP is again conveyed toward the image forming unit 120 so as to form an image on the back side of the sheet P.

Figure 2:
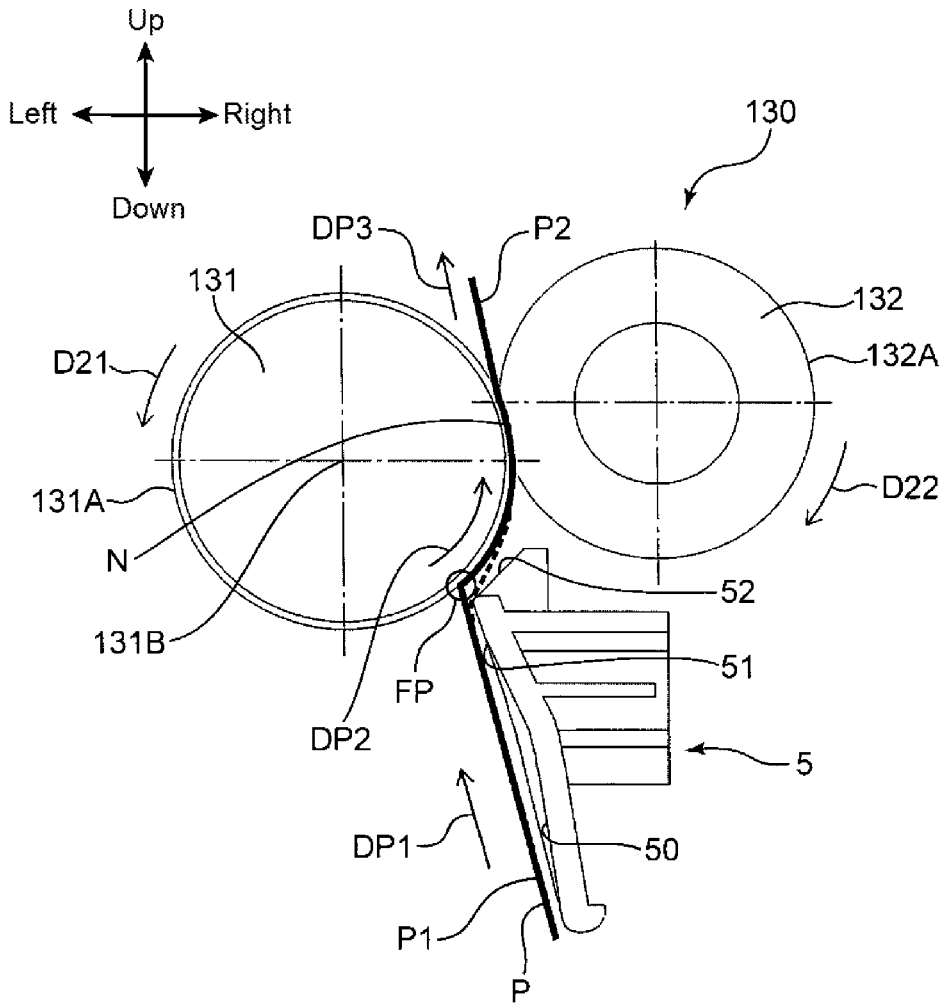
FIG. 2 cross-sectionally illustrates a fixing device according to the one embodiment.
Figure 3:
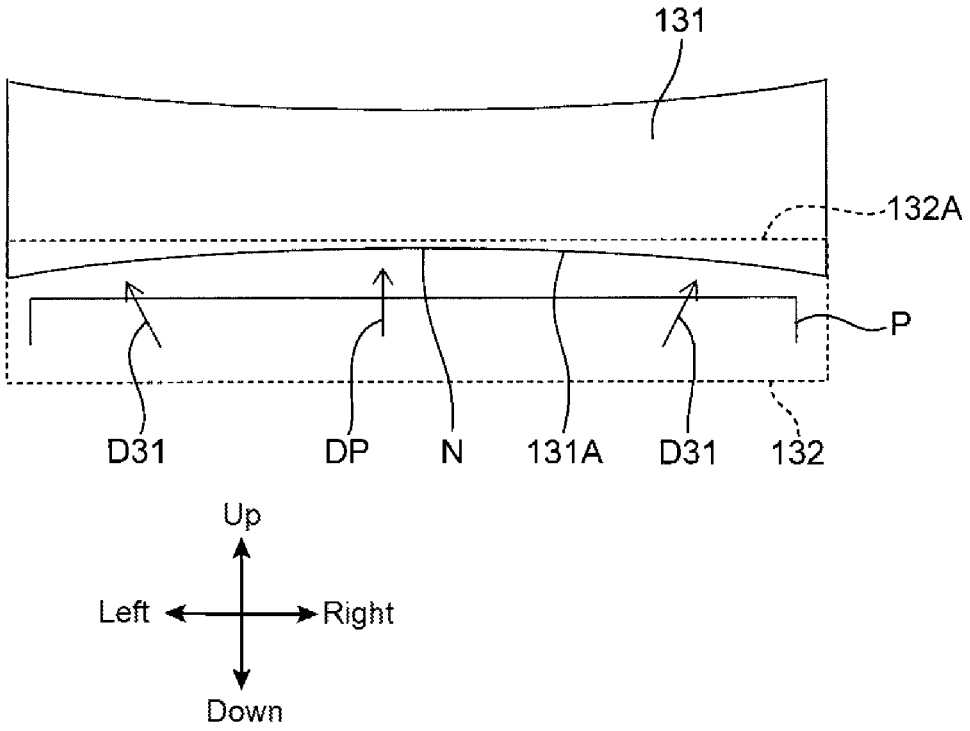
FIG. 3 schematically illustrates the bottom of the fixing device according to the one embodiment.

The following describes the fixing device 130 according to the embodiment with reference to FIG. 2 and FIG. 3 in addition to FIG. 1. FIG. 2 cross-sectionally illustrates the fixing device 130 according to the embodiment. FIG. 2 illustrates the cross section perpendicular to the axial direction of the fixing roller 131 of the fixing device 130. FIG. 3 schematically describes a force to be applied to the sheet P in the fixing device 130 according to the embodiment. Here, the fixing device 130 includes a housing (not illustrated) that supports the respective members.

The fixing roller 131 is constituted of, for example, a cylindrical-shaped member and a coating layer (such as fluororesin layer). The cylindrical-shaped member is formed of a metal excellent in heat conductivity, for example, aluminum and iron. The coating layer coats the surface of this cylindrical-shaped member. In the internal space of the fixing roller 131, a heater (not illustrated) is housed. The heater is constituted of, for example, a halogen heater or a ceramic heater. This heater is configured to generate heat by energization so as to heat the fixing roller 131. The fixing roller 131 includes a first circumference surface 131A and a fixing roller shaft 131B. The first circumference surface 131A is a circumference surface to be brought into contact with a first sheet surface P1 (see FIG. 2) of the sheet P. On the first sheet surface P1 of the sheet P, a toner image is formed by the image forming unit 120. The fixing roller shaft 131B is a rotation shaft for rotation of the fixing roller 131.

The pressure roller 132 is constituted of, for example, a base material layer in a cylindrical shape, an elastic layer, and a coating layer. The base material layer is formed of, for example, a synthetic resin and a metal. The elastic layer is formed of a silicon rubber and similar material, and located around the above-described base material layer. The coating layer is formed of a fluororesin and similar material to coat the above-described elastic layer. The pressure roller 132 includes a second circumference surface 132A. The pressure roller 132 is pressed by a biasing force of a biasing mechanism (not illustrated) while applying a predetermined load to the first circumference surface 131A of the fixing roller 131. As a result, a fixing nip portion N is formed between the fixing roller 131 and the pressure roller 132. The sheet P passes through the fixing nip portion N. Here, the second circumference surface 132A of the pressure roller 132 is brought into contact with a second sheet surface P2 (see FIG. 2) on the opposite side to the above-described first sheet surface P1.

The pressure roller 132 is rotatably driven by a driving mechanism (not illustrated) in the direction of an arrow D22 in FIG. 2. The fixing roller 131 rotates following the rotation of the pressure roller 132 (as illustrated by an arrow D21 in FIG. 2). Here, in another embodiment, the fixing roller 131 may be rotatably driven by a driving mechanism (not illustrated) such that the pressure roller 132 rotates following the rotation of the fixing roller 131.

With reference to FIG. 3, in the embodiment, the first circumference surface 131A of the fixing roller 131 has the inverted crown shape. In this inverted crown shape, the outer diameter of the center portion in the axial direction (the front-rear direction) of the fixing roller shaft 131B is a diameter smaller than the outer diameters of both the end portions in the axial direction. Specifically, in the embodiment, as one example, the outer diameter of the center portion in the axial direction of the fixing roller 131 is 24.82 mm and the outer diameters of both the end portions are 24.92 mm. The length of the fixing roller 131 (the coating layer) in the axial direction is 226 mm. The difference between the outer diameter of the end portion in the axial direction of the fixing roller 131 and the outer diameter of the center portion in the axial direction of the fixing roller 131 is set to a range of 0.1 mm±0.02 mm. On the other hand, the second circumference surface 132A of the pressure roller 132 has a straight shape along the axial direction. Specifically, in the embodiment, the outer diameter of the pressure roller 132 is 23 mm. The length of the pressure roller 132 in the axial direction is 216 mm. Here, since FIG. 3 illustrates a state where the pressure roller 132 is pressed against the fixing roller 131, the second circumference surface 132A overlaps the first circumference surface 131A. In practice, the second circumference surface 132A of the pressure roller 132 is compressively deformed along the first circumference surface 131A of the fixing roller 131. In other words, the fixing nip portion N has a shape along the inverted crown shape of the first circumference surface 131A. Here, the nip width of the fixing nip portion N along the sheet conveyance direction is set to 4 mm in both the end portions and set to 2.7 mm in the center portion in the sheet width direction.

As described above, when the fixing roller 131 and the pressure roller 132 rotate in the respective directions of the arrows D21 and D22 in FIG. 2, the sheet P is conveyed to pass through the fixing nip portion N. When the first circumference surface 131A of the fixing roller 131 has the inverted crown shape as described above, the peripheral velocity of the center portion in the axial direction of the first circumference surface 131A is faster than the peripheral velocity of the end portion in the axial direction of the first circumference surface 131A. As a result, as illustrated in FIG. 3, the sheet P is conveyed (as illustrated by an arrow D31 in FIG. 3) while both the end portions in the axial direction (the front-rear direction) of the sheet P passing through the fixing nip portion N are pulled outward. This consequently forms a stable nip width over the entire sheet P in the axial direction in the fixing nip portion N.

However, when the posture of the sheet P heading for the fixing nip portion N becomes unstable at the upstream side of the fixing nip portion N in the conveyance direction (as illustrated by an arrow DP in FIG. 3), this unstable posture interferes with the above-described behavior in which the sheet P is conveyed while being pulled outward in the axial direction. This may cause a paper wrinkle, springing back in the rear end portion of the sheet P, a worm-shaped image defect described later, and similar problem.

Figure 4:
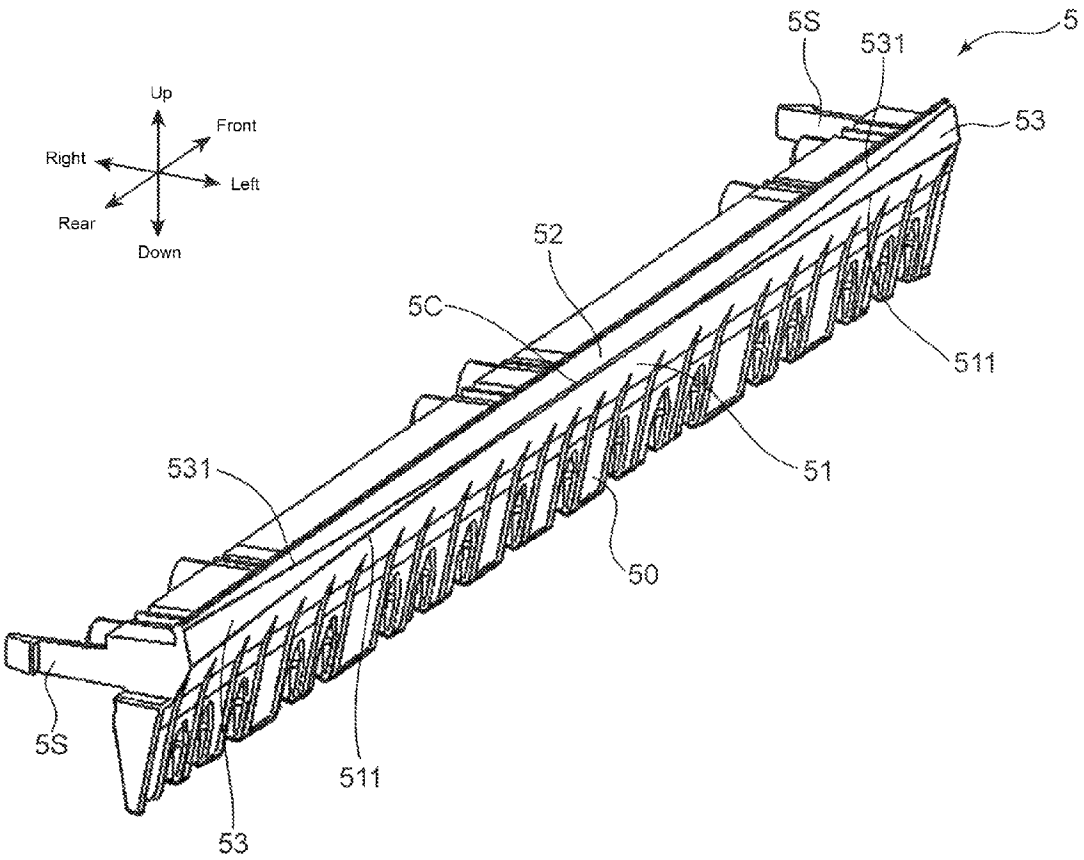
FIG. 4 perspectively illustrates a guiding member according to the one embodiment.
Figure 5:
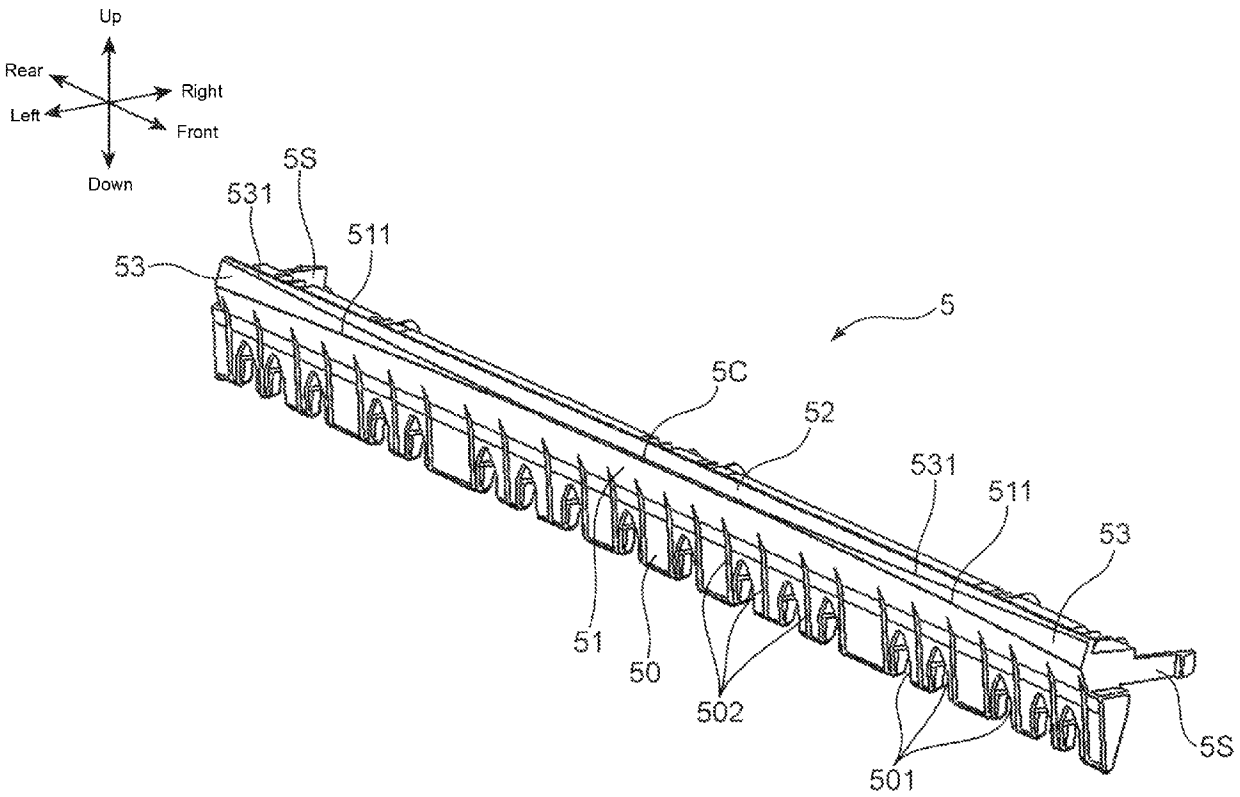
FIG. 5 perspectively illustrates the guiding member according to the one embodiment.
Figure 6:
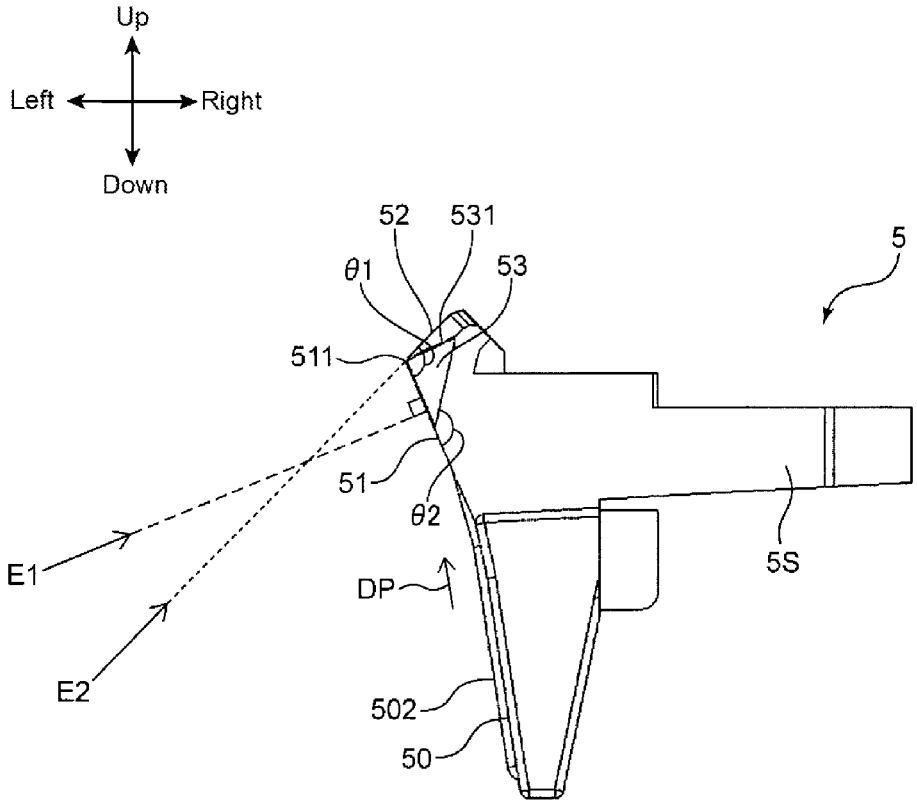
FIG. 6 cross-sectionally illustrates the guiding member according to the one embodiment.
Figure 7:
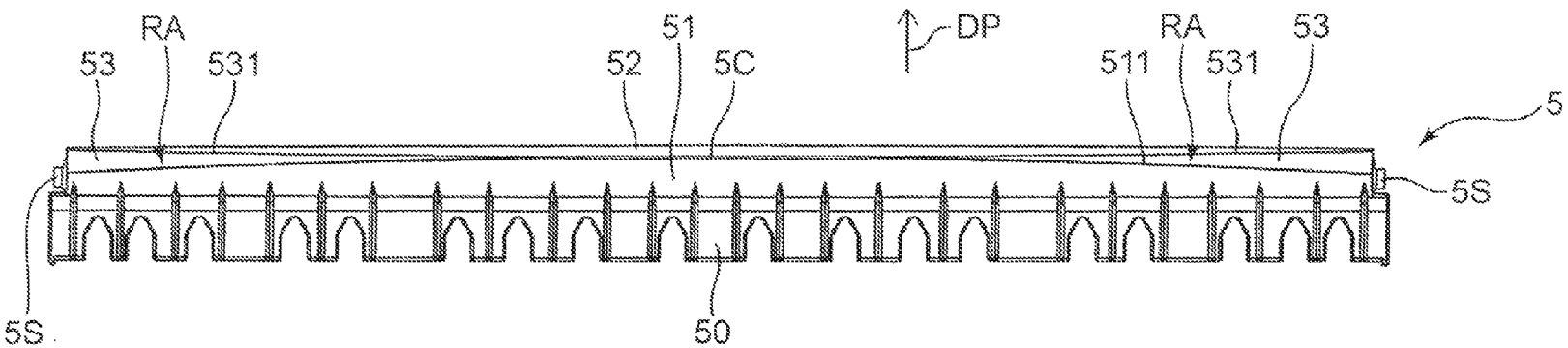
FIG. 7 illustrates the guiding member according to the one embodiment, viewed from a direction perpendicular to a first guide surface.
Figure 8:
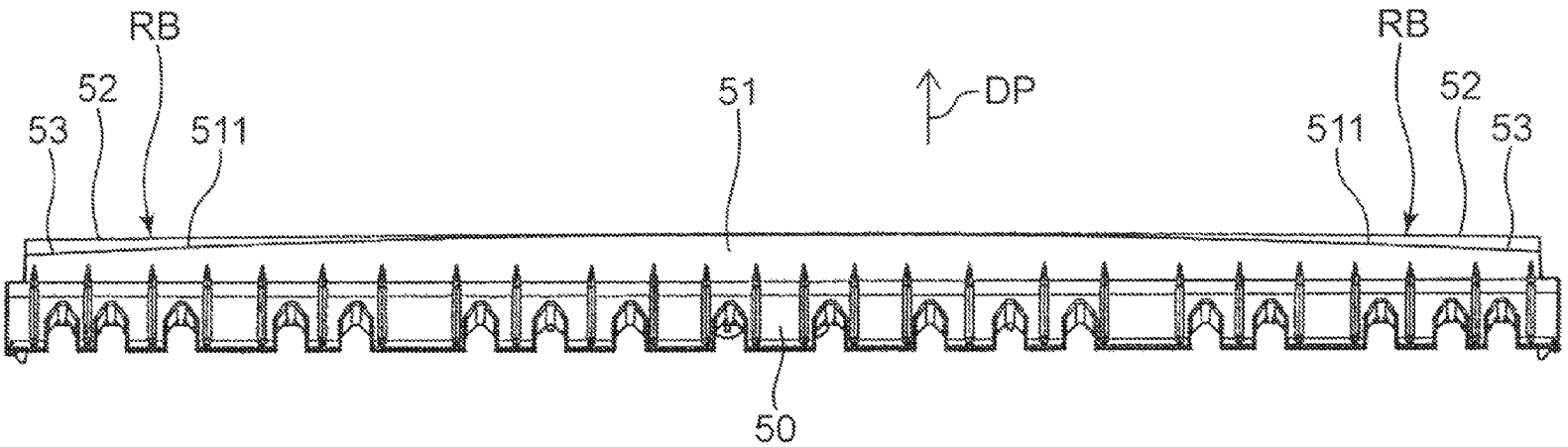
FIG. 8 illustrates the guiding member according to the one embodiment, viewed from a direction along a second guide surface.

To solve this problem described above, in the embodiment, the fixing device 130 includes a sheet guide 5 (guiding member). The following describes the sheet guide 5 in detail with reference to FIG. 4 to FIG. 8 in addition to FIG. 2 and FIG. 3. FIG. 4 and FIG. 5 perspectively illustrate the sheet guide 5 according to the embodiment. FIG. 6 cross-sectionally illustrates the sheet guide 5 according to the embodiment. In FIG. 6, the sheet guide 5 is viewed in the cross section perpendicular to the fixing roller shaft 131B (see FIG. 2). FIG. 7 illustrates the sheet guide 5 according to the embodiment from the direction perpendicular to a first guide surface 51 described later. FIG. 8 illustrates the sheet guide 5 viewed from the direction along a second guide surface 52 described later.

As illustrated in FIG. 5, the sheet guide 5 is an approximately triangular member in front view, and is a plate-shaped member extended in the front-rear direction. The sheet guide 5 is formed by resin molding. As illustrated in FIG. 2, the sheet guide 5 is arranged at a predetermined distance from the first circumference surface 131A of the fixing roller 131 below the fixing nip portion N. The sheet guide 5 has a function that brings the sheet P into abutting contact with the first circumference surface 131A of the fixing roller 131 and then guides the sheet P to the fixing nip portion N.

The sheet guide 5 includes an introduction guide surface 50, a cutout portion 501 (see FIG. 5), a guiding rib 502 (see FIG. 5), a first guide surface 51, a second guide surface 52, third guide surfaces 53, and a mounting piece 5S.

With reference to FIG. 6, the introduction guide surface 50 is a guide surface arranged in the left lower portion of the sheet guide 5. The introduction guide surface 50 is a guide surface with which the sheet P conveyed toward the fixing device 130 is firstly brought into contact in the sheet guide 5. The cutout portion 501 is a cutout portion where a part of the lower end portion of the introduction guide surface 50 is cut out upward. A plurality of the cutout portions 501 are arranged at a distance from one another in the sheet width direction (the front-rear direction). Here, a plurality of guide ribs (not illustrated) are inserted into the plurality of the cutout portions 501. The plurality of guide ribs are arranged in the sheet conveyance path at the upstream side in the sheet conveyance direction (at the lower side) of the fixing device 130. Thus, the guide rib is arranged to enter a part of the introduction guide surface 50. This steadily achieves delivery of the sheet P from the sheet conveyance path to the sheet guide 5. Further, the guiding rib 502 is a rib member arranged along the sheet conveyance direction on the introduction guide surface 50. A plurality of the guiding ribs 502 are arranged at a distance from one another in the front-rear direction. The guiding ribs 502 are arranged to sandwich the cutout portion 501 in the sheet width direction. The guiding rib 502 guides the sheet P from the introduction guide surface 50 to the first guide surface 51.

The first guide surface 51 is a guide surface consecutively installed on the upper side of the introduction guide surface 50. As illustrated in FIG. 6, the first guide surface 51 is arranged to slightly intersect with the introduction guide surface 50. As illustrated in FIG. 2, the first guide surface 51 is located to extend toward the first circumference surface 131A at the upstream side of the fixing nip portion N in the rotation direction (as illustrated by the arrow D21 in FIG. 2) of the fixing roller 131. The first guide surface 51 guides the sheet P toward the first circumference surface 131A. The first guide surface 51 includes a first end edge 511 (see FIG. 4 to FIG. 8). The first end edge 511 is an end edge arranged to face the first circumference surface 131A on the first guide surface 51. The first end edge 511 has a circular arc shape as described later.

The second guide surface 52 is located at the downstream side of the first guide surface 51 in the rotation direction of the fixing roller 131. The second guide surface 52 is a guide surface consecutively installed on the first guide surface 51 to intersect with the first guide surface 51 on the first end edge 511. Here, as described later, the second guide surface 52 is consecutively installed on the first guide surface 51 in a center continuous portion 5C (see FIG. 4, FIG. 5, and FIG. 7). The center continuous portion 5C is the center portion in the axial direction (the sheet width direction) of the first end edge 511. As illustrated in FIG. 2, the second guide surface 52 is arranged along the first circumference surface 131A. Further, the second guide surface 52 is located to extend toward the second circumference surface 132A of the pressure roller 132. The second guide surface 52 is arranged to enter the fixing nip portion N side from the first guide surface 51.

The third guide surfaces 53 are a pair of guide surfaces for consecutively installing the first guide surface 51 and the second guide surface 52 on both the end portions in the sheet width direction of the sheet guide 5. Each of the third guide surfaces 53 has an approximately isosceles triangular shape where the vertex is located on the center continuous portion 5C side. The base of the third guide surface 53 is formed by a part of the end edge in the front-rear direction of the sheet guide 5. One side of the third guide surface 53 is constituted by a part of the first end edge 511. The other side of the third guide surface 53 is the boundary line between the second guide surface 52 and the third guide surface 53. The boundary line is defined as a second end edge 531.

Further to the shape of the sheet guide 5, with reference to FIG. 6, the introduction guide surface 50 is arranged at the upstream side of the sheet guide 5 in the sheet conveyance direction (as illustrated by the arrow DP). The introduction guide surface 50 is slightly inclined toward the left side in the upward direction. The first guide surface 51 is consecutively installed on the introduction guide surface 50. The first guide surface 51 is arranged to be inclined toward the left side with respect to the introduction guide surface 50 in the upward direction. In the center portion in the sheet width direction of the sheet guide 5, the guide surface of the sheet guide 5 in the first end edge 511 is bent rightward and upward so as to form the second guide surface 52. The lower end edge of the second guide surface 52 is defined by the second end edge 531 formed rising toward the leading end in both the end portions in the sheet width direction from the center continuous portion 5C. On the other hand, in both the end portions in the sheet width direction of the sheet guide 5, the lower end edge (the second end edge 531) of the second guide surface 52 is arranged at a predetermined distance from the first end edge 511 of the first guide surface 51 in the upward direction. A pair of the third guide surfaces 53 are arranged to fill a gap between the first end edge 511 and the second end edge 531.

The mounting piece 5S is a hook located to protrude rightward from each end portion in the sheet width direction of the sheet guide 5. The mounting piece 5S is mounted on the opening that is opened in a housing (not illustrated) of the fixing device 130. As a result, the sheet guide 5 is secured to the housing.

The following describes the shapes of the first guide surface 51, the second guide surface 52, and the third guide surface 53 and the positional relationship between these guide surfaces when the sheet guide 5 is mounted on the fixing device 130 further in detail. As described above, FIG. 7 illustrates the sheet guide 5 viewed from the direction (illustrated by an arrow E1 in FIG. 6) perpendicular to the first guide surface 51. In FIG. 7, the first end edge 511 of the first guide surface 51 has a first circular arc shape RA. In the first circular arc shape RA, the center portion in the axial direction (the sheet width direction) of the fixing roller 131 is arranged to project toward the downstream side in the rotation direction (illustrated by the arrow D21 in FIG. 2) of the fixing roller 131 with respect to both the end portions in the axial direction. In the embodiment, the curvature radius of the first circular arc shape RA is set to be equal to or more than 2000 mm and equal to or less than 4000 mm. More preferably, the curvature radius of the first circular arc shape RA is set to be equal to or more than 2800 mm and equal to or less than 3000 mm.

On the other hand, FIG. 8 illustrates the second guide surface 52 viewed from the upstream side in the rotation direction of the fixing roller 131 from the direction (illustrated by an arrow E2 in FIG. 6) along the second guide surface 52. In this case, the second guide surface 52 is visually recognized as one ridge line. On the second guide surface 52, the center portion in the axial direction of the fixing roller 131 is arranged closer to the first circumference surface 131A than both the end portions in the axial direction (see FIG. 2 and FIG. 6). Furthermore, the second guide surface 52 is a curved surface having the second circular arc shape RB with a larger curvature radius than that of the first circular arc shape RA (see FIG. 8). In the embodiment, the curvature radius of the second circular arc shape RB is set to be equal to or more than 5000 mm, more preferably, set to be equal to or more than 10000 mm. Here, in the other embodiment, as illustrated in FIG. 8, the second guide surface 52 may be a planar surface visually recognized as a straight shape when the second guide surface 52 is viewed from the upstream side in the rotation direction of the fixing roller 131 from the direction (illustrated by the arrow E2 in FIG. 6) along the second guide surface 52.

Further, as described above, the third guide surface 53 is a guide surface for consecutively installing both the end portions in the sheet width direction (the axial direction of the fixing roller 131) of the first guide surface 51 and both the end portions in the sheet width direction of the second guide surface 52, along the conveyance direction of the sheet P. As illustrated in FIG. 6, in the cross-sectional view intersecting with the axial direction, the third guide surface 53 is arranged such that an angle 82 (second angle) formed by the first guide surface 51 and the third guide surface 53 in both the end portions in the axial direction of the first end edge 511 is larger than an angle θ1 (first angle) formed by the first guide surface 51 and the second guide surface 52 in the center portion (the center continuous portion 5C) in the axial direction of the first end edge 511.

Operation of First Guide Surface 51

The following describes the operation of the sheet guide 5 according to the embodiment. With reference to FIG. 2, the sheet P carried in the introduction guide surface 50 of the sheet guide 5 abuts on the first circumference surface 131A (in a position FP in FIG. 2) of the fixing roller 131 while being guided to the first guide surface 51 (as illustrated by an arrow DP1 in FIG. 2). Subsequently, the sheet P is guided to the fixing nip portion N along the first circumference surface 131A (as illustrated by an arrow DP2 in FIG. 2). Subsequently, the sheet P is carried out from the fixing nip portion N (as illustrated by an arrow DP3 in FIG. 2). This entrance of the sheet P to the fixing nip portion N along the first circumference surface 131A of the fixing roller 131 causes the fixing roller 131 to preliminarily supply heat to the sheet P and to the toner image on the sheet P (preheating). This consequently improves the fixing performance for the toner image on the sheet P. In the intersection point between: the extended line (not illustrated) of the first guide surface 51 extended toward the first circumference surface 131A of the fixing roller 131; and the first circumference surface 131A, the angle formed by the tangent line of the first circumference surface 131A and this extended line is set to 63 degrees. Here, the tangent line is a tangent line drawn from this intersection point toward the upstream side in the rotation direction of the fixing roller 131. The angle formed by the tangent line and the extended line may be set to a range from 50 degrees to 75 degrees.

In FIG. 2, at the downstream side of the position FP, the solid line illustrates a state where the sheet P is conveyed on the first circumference surface 131A. However, after the leading end portion of the sheet P enters the fixing nip portion N, the sheet surface of the sheet P is slightly uplifted and then conveyed as illustrated by the dashed line in FIG. 2. In other words, in this case, the portion of the sheet guide 5 in contact with the sheet surface of the sheet P at the end is the first end edge 511 of the first guide surface 51. Accordingly, the posture when the sheet surface of the sheet P heads for the fixing nip portion N is determined by the shape of the first end edge 511.

As described above, the fixing roller 131 has the inverted crown shape. Accordingly, while both the end portions in the sheet width direction of the sheet P are pulled outward, the sheet P is conveyed in the fixing nip portion N (the sheet P is stiffened by the fixing roller 131). This embodiment employs the first circular arc shape RA in which the center portion of the first end edge 511 of the first guide surface 51 projects toward the sheet conveyance direction with respect to both the end portions. Accordingly, at the upstream side of the fixing nip portion N in the sheet conveyance direction, while the center portion of the first end edge 511 supports the center portion in the sheet width direction of the sheet P, both the end portions of the first end edge 511 can assist the above-described behavior of both the end portions of the sheet P in the fixing nip portion N. In other words, if the first end edge 511 is located to linearly extend along the sheet width direction or if the curvature radius of the first circular arc shape RA of the first end edge 511 is set to a large curvature radius equal to or more than 5000 mm, both the end portions of the first end edge 511 might hinder the above-described behavior of the sheet P in the fixing nip portion N. This consequently provides an unstable force to the sheet P in the fixing nip portion N. Thus, a paper wrinkle, springing back of the trailing end of the sheet P, and a worm-shaped image defect are likely to occur.

Here, the worm-shaped image defect is an image defect that occurs on a fixed image due to displacement of a part of the toner image on the sheet P immediately before the sheet P enters the fixing nip portion N. In this defect, the image is disturbed like track of a crawling worm. The behavior of the sheet P is regulated by the first end edge (not illustrated) located to linearly extend along the sheet width direction. On the other hand, when a moving force for movement in the sheet width direction acts on the sheet P due to the inverted crown shape of the fixing roller 131, the toner image is slipped and the above-described phenomenon is likely to occur in the toner image on the sheet P.

In the embodiment, as described above, the curvature radius of the first circular arc shape RA of the first guide surface 51 is set to be equal to or more than 2000 mm and equal to or less than 4000 mm. More preferably, the curvature radius of the first circular arc shape RA is set to be equal to or more than 2800 mm and equal to or less than 3000 mm. Accordingly, the first end edge 511 can steadily maintain the posture (deflection) of the sheet P at the upstream side of the fixing nip portion N. Accordingly, a stable fixing process is performed on the sheet P without hindering the behavior of the sheet P in the fixing nip portion N. In particular, setting the curvature radius of the first circular arc shape RA to be equal to or more than 2000 mm suppresses the formation of excessive deflections in the sheet P. As a result, the sheet P can smoothly enter the fixing nip portion N. On the other hand, setting the curvature radius of the first circular arc shape RA to be equal to or less than 4000 mm suppresses regulation on the sheet P in a straight line along the sheet width direction in the first end edge 511. As a result, the sheet P can enter the fixing nip portion N in the state where the sheet P has a preferred deflection shape along the sheet width direction.

Operation of Second Guide Surface 52

Figure 9:
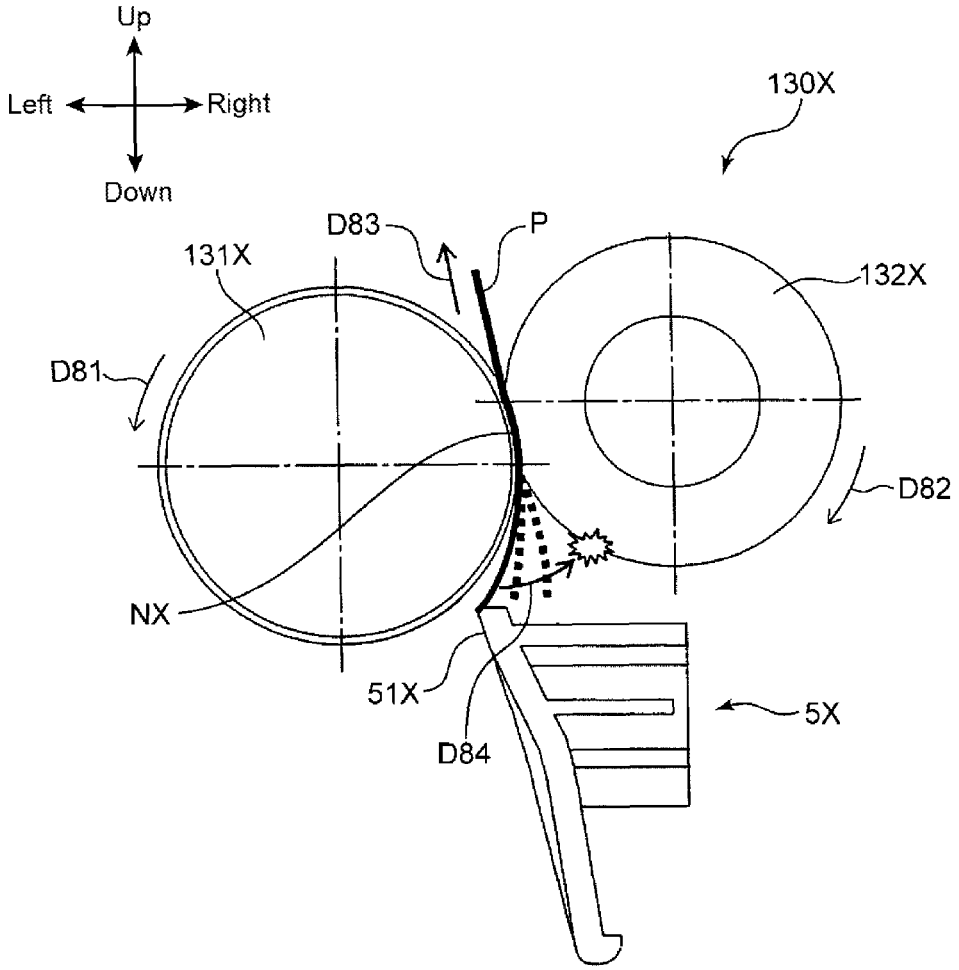
FIG. 9 cross-sectionally illustrates a state where the rear end portion of a sheet springs back in another guiding member as a comparison with the guiding member according to the one embodiment.

The following describes the operation of the second guide surface 52 of the sheet guide 5. FIG. 9 schematically and cross-sectionally describes the behavior of the sheet P in a fixing device 130X that includes another sheet guide 5× as a comparison with the sheet guide 5 according to the embodiment. The fixing device 130X includes a fixing roller 131X, a pressure roller 132X, and a sheet guide 5X. The sheet guide 5X is different from the sheet guide 5 according to the embodiment in that the second guide surface 52 and the third guide surface 53 are not provided. With reference to FIG. 9, a fixing nip portion NX is formed between the fixing roller 131× and the pressure roller 132X. The fixing roller 131× and the pressure roller 132X are rotated (as illustrated by respective arrows D81 and D82), and then the sheet P passes through the fixing nip portion NX while being guided by the first guide surface 51X of the sheet guide 5X as illustrated by an arrow D83 in FIG. 9. Finally, when the rear end portion of the sheet P leaves from the first guide surface 51X, the rear end portion of the sheet P is moved to the pressure roller 132X side by a strong force due to stiffening of the sheet P in the fixing nip portion NX (as illustrated by an arrow D84 in FIG. 9). At this time, the toner on the sheet P may be scattered at the boundary portion on the entrance side of the fixing nip portion NX by the impact received by the sheet P, and bands along the sheet width direction may be generated on the toner image. Alternatively, immediately before the sheet P reaches the fixing nip portion N, the toner image may have image rubbing or an image defect in a throwing star shape.

On the other hand, in the embodiment, as illustrated in FIG. 2 and FIG. 6, the second guide surface 52 is arranged at the downstream side of the first guide surface 51. The second guide surface 52 has a function that guides the rear end portion of the sheet P along the first circumference surface 131A of the fixing roller 131 after the rear end portion passes through the first end edge 511. This prevents the image defect generated by springing back of the rear end portion of the sheet P toward the pressure roller 132 side as described above. As described above, the sheet P is carried into the fixing nip portion N in the state where the rear end portion of the sheet P is close to the first circumference surface 131A of the fixing roller 131. As a result, also in the rear end portion of the sheet P, heat is preliminarily supplied from the fixing roller 131 to the sheet P and to the toner image on the sheet P (as preheating). This consequently improves the fixing performance for the toner image on the sheet P in the entire region in sheet conveyance direction.

In order to prevent the springing back of the rear end portion of the sheet P as described above over the entire sheet width direction, the curvature radius of the second circular arc shape RB of the second guide surface 52 is preferred to be set to be comparatively large. That is, as described above, the portion of the first guide surface 51 in contact with the sheet P at the end is the first end edge 511. Then, the first circular arc shape RA of the first end edge 511 is set to have a comparatively small curvature radius (equal to or more than 2000 mm and equal to or less than 4000 mm). However, if the curvature radius of the second circular arc shape RB of the second guide surface 52 is set to be the same as that of the first circular arc shape RA, it becomes difficult to suppress the springing back of both the end portions in the sheet width direction of the sheet P. Accordingly, in the embodiment, the second guide surface 52 is designed to be a curved surface having the second circular arc shape RB that has a larger curvature radius than that of the first circular arc shape RA. As described above, setting a large curvature radius of the second circular arc shape RB prevents the situation where only the center portion (the region that passes near the center continuous portion 5C of the first end edge 511) in the sheet width direction of the sheet P becomes close to the first circumference surface 131A of the fixing roller 131. In other words, the sheet P is carried into the fixing nip portion N while the entire region in the sheet width direction of the sheet P is steadily close to the first circumference surface 131A of the fixing roller 131. This steadily achieves the above-described preheating. Here, when the second guide surface 52 is viewed from the upstream side in the rotation direction of the fixing roller 131 from the direction (illustrated by the arrow E2 in FIG. 6) along the second guide surface 52, the second guide surface 52 may be a planar surface. Also in this case, the configuration prevents the springing back of the rear end portion of the sheet P after passage through the first end edge 511 in the entire region in the sheet width direction and steadily achieves preheating, thus improving the fixing performance for the sheet P.

Thus, in the embodiment, on the first guide surface 51 for guiding the leading end side of the sheet P to the fixing nip portion N from the fixing roller 131, the curvature radius of the first circular arc shape RA of the first end edge 511 is set to be comparatively small. On the other hand, the curvature radius of the second circular arc shape RB is set to be larger than the curvature radius of the first circular arc shape RA at the second guide surface 52 for supporting the rear end portion of the sheet P after the rear end portion passes through the first end edge 511. As a result, this steadily maintains the posture of the sheet P based on the inverted crown shape of the fixing roller 131 while the rear end portion of the sheet P passes through the first end edge 511 after the leading end portion of the sheet P is carried in the fixing nip portion N. On the other hand, this steadily prevents the springing back of the rear end portion of the sheet P toward the pressure roller 132 side in the upward direction after the rear end portion passes through the first end edge 511.

Operation of Third Guide Surface 53

Additionally, as described above, the first guide surface 51 and the second guide surface 52 are consecutively installed in the center continuous portion 5C. On the other hand, in the sheet width direction, both the respective end portions of the first guide surface 51 and the second guide surface 52 are consecutively installed by the third guide surface 53. With reference to FIG. 6, the angle 82 formed by the first guide surface 51 and the third guide surface 53 in both the end portions in the axial direction of the first end edge 511 is set to be larger than the angle θ1 formed by the first guide surface 51 and the second guide surface 52 in the center in the axial direction of the first end edge 511. In the embodiment, the angle θ1 is set to 116 degrees while the angle 82 is set to 137 degrees. Regarding the above description, in other words, the angle formed by the extended surface of the first guide surface 51 and the third guide surface 53 in both the end portions in the axial direction of the first end edge 511 is set to be smaller than the angle formed by the extended surface of the first guide surface 51 and the second guide surface 52 in the center in the axial direction of the first end edge 511. The center continuous portion 5C of the first end edge 511 projects toward the downstream side in the sheet conveyance direction with respect to both the end portions of the first end edge 511.

The first circular arc shape RA of the first end edge 511 is set to have a comparatively small curvature radius (equal to or more than 2000 mm and equal to or less than 4000 mm). The curvature radius of the second circular arc shape RB of the second guide surface 52 is set to be equal to or more than 5000 mm. Accordingly, when the rear end portion of the sheet P passes through the first end edge 511, both the end portions in the sheet width direction of the rear end portion are moved along the second circular arc shape RB from the first circular arc shape RA. At this time, as described above, since the third guide surface 53 intersects with the first guide surface 51 at a smaller angle than that of the second guide surface 52, both the end portions in the sheet width direction of the sheet P are smoothly delivered from the first guide surface 51 to the second guide surface 52. As a result, this further prevents scattering of the toner in the rear end portion of the sheet P and more steadily maintains the fixing performance for the sheet P.

In other words, the above-described operation can cause the third guide surface 53 to assist the conveyance of the sheet P without delay of both the end portions with respect to the center portion in the sheet width direction of the sheet P when the rear end portion of the sheet P leave from the first end edge 511. Thus, in the embodiment, the second guide surface 52 and the third guide surface 53 solve the problem that is likely to occur after the rear end portion of the sheet P leaves from the first end edge 511 of the first guide surface 51 in the rear end portion of the sheet P.

On the other hand, as described above, the first guide surface 51 and the second guide surface 52 are consecutively installed in the center continuous portion 5C. Accordingly, the center portion in the sheet width direction of the rear end portion of the sheet P is smoothly delivered from the first guide surface 51 to the second guide surface 52. This reliably reduces the above-described springing back of the rear end portion of the sheet P starting from the center portion in the sheet width direction.

While the fixing device 130 according to the one embodiment of the disclosure and the image forming apparatus 1 that includes the fixing device 130 have been described above, the disclosure is not limited to this. For example, the disclosure can employ the following modified embodiments.

(1) While in the above-described embodiments the configuration where the second guide surface 52 has a curved surface in the second circular arc shape RB has been described, the disclosure is not limited to this. As described above, the second guide surface 52 may have a shape with a planar surface. In this case, the center continuous portion 5C and the second end edge 531 may be constituted of curved ridge lines so as to consecutively install the first guide surface 51 and the third guide surface 53 on the second guide surface 52.

(2) While in the above-described embodiments the fixing member is described as the fixing roller 131 and the pressure member is described as the pressure roller 132, the disclosure is not limited to this. The respective above-described members may be constituted of a belt member that moves circularly, a pressing pad that presses the belt member against another member, and similar member.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A fixing device for performing a fixing process on a sheet including a first sheet surface on which a toner image is formed, the fixing device comprising:

a fixing member that includes a first circumference surface, the fixing device being configured to rotate the fixing member in a predetermined rotation direction, the fixing device being configured to bring the first circumference surface into contact with the first sheet surface;

a pressure member that includes a second circumference surface, the fixing device being configured to press the pressure member against the first circumference surface of the fixing member so as to form a fixing nip portion through which the sheet passes between the pressure member and the fixing member, the fixing device being configured to bring the second circumference surface into contact with a second sheet surface on an opposite side of the first sheet surface; and a guiding member arranged at a predetermined distance from the first circumference surface, the guiding member being configured to bring the sheet into abutting contact with the first circumference surface of the fixing member and then guide the sheet to the fixing nip portion; wherein:

the first circumference surface of the fixing member is constituted to have a smaller outer diameter of the center portion in an axial direction during the rotation than outer diameters of both end portions in the axial direction; and the guiding member includes a first guide surface that includes a first end edge arranged to face the first circumference surface, the first guide surface being located to extend toward the first circumference surface at an upstream side of the fixing nip portion in the rotation direction, the first guide surface being configured to guide the sheet to the first circumference surface, a second guide surface at a downstream side of the first guide surface in the rotation direction, the second guide surface being consecutively installed on the first guide surface to intersect with the first guide surface in a center in the axial direction of the first end edge, the second guide surface being arranged along the first circumference surface, and a pair of third guide surfaces consecutively installing both end portions in the axial direction of the first guide surface and both end portions in the axial direction of the second guide surface, wherein in a view from a direction perpendicular to the first guide surface, the first end edge of the first guide surface has a first circular arc shape arranged such that a center portion in the axial direction projects toward the downstream side in the rotation direction with respect to both end portions in the axial direction, and when the second guide surface is viewed from a direction along the second guide surface from the upstream side in the rotation direction, the second guide surface is one of a curved surface in a second circular arc shape and a planar surface, the second circular arc shape being arranged such that a center portion in the axial direction is close to the first circumference surface with respect to both end portions in the axial direction.

2. The fixing device according to claim 1, wherein:

the second guide surface includes a curved surface having the second circular arc shape; and the second circular arc shape has a curvature radius larger than a curvature radius of the first circular arc shape.

3. The fixing device according to claim 1, wherein:

in a cross-sectional view intersecting with the axial direction, a second angle formed by the first guide surface and the third guide surface in both the end portions in the axial direction of the first end edge is larger than a first angle formed by the first guide surface and the second guide surface in the center in the axial direction of the first end edge.

4. The fixing device according to claim 1, wherein:

the first circular arc shape has a curvature radius equal to or more than 2000 mm and equal to or less than 4000 mm.

5. The fixing device according to claim 4, wherein:

the second guide surface includes a curved surface having the second circular arc shape; and the second circular arc shape has a curvature radius equal to or more than 5000 mm.

6. An image forming apparatus, comprising:

an image forming unit configured to form an image on a sheet; and the fixing device according to claim 1.

* * * * *